United States Patent [19]

Sagawa

[11] Patent Number: 4,558,003

[45] Date of Patent: Dec. 10, 1985

[54] HARDENING OF POLY(VINYL ACETAL)

[75] Inventor: Kiyoshi B. Sagawa, Bloomington, Minn.

[73] Assignee: Minnesota Mining and Manufacturing Company, St. Paul, Minn.

[21] Appl. No.: 588,917

[22] Filed: Mar. 12, 1984

[51] Int. Cl.[4] ..... G03C 1/30

[52] U.S. Cl. ..... 430/617; 430/618; 430/619; 430/620; 260/117

[58] Field of Search ..... 430/621, 619, 617, 618, 430/620; 260/117

[56] References Cited

U.S. PATENT DOCUMENTS

| | | | |
|---|---|---|---|
| 2,310,223 | 2/1943 | Eaton et al. | 430/621 |
| 2,367,548 | 1/1945 | Vittum | 430/621 |
| 3,672,904 | 6/1972 | de Mauriac | 430/617 |

*Primary Examiner*—Won H. Louie

*Attorney, Agent, or Firm*—Donald M. Sell; James A. Smith; Mark A. Litman

[57] ABSTRACT

The addition of a boric acid or borate ion to a poly(vinyl acetal) composition has been found to cause hardening of the composition. The hardened composition is particularly useful in photothermographic emulsions having a poly(vinyl acetal) layer.

19 Claims, No Drawings

HARDENING OF POLY(VINYL ACETAL)

BACKGROUND OF THE INVENTION

1. Field of the Invention

This invention relates to a crosslinked poly(vinyl acetal) composition and a process for cross-linking poly(vinyl acetal) resins.

This invention also relates to photothermographic imaging elements and to the protection of the element from surface deformation during thermal development by crosslinking a poly(vinyl acetal) binder layer in the element.

2. Background of the Art

Silver halide photothermographic imaging materials, often referred to as 'dry silver' compositions because no liquid development is necessary to produce the final image, have been known in the art for many years. These imaging materials basically comprise a light insensitive, reducible silver source, a light sensitive material which generates silver when irradiated, and a reducing agent for the silver source. The light sensitive material is generally photographic silver halide which must be in catalytic proximity to the light insensitive silver source. Catalytic proximity is an intimate physical association of these two materials so that when silver specks or nuclei are generated by the irradiation or light exposure of the photographic silver halide, those nuclei are able to catalyze the reduction of the silver source by the reducing agent. It has been long understood that silver is a catalyst for the reduction of silver ions and the silver-generating light sensitive silver halide catalyst progenitor may be placed into catalytic proximity with the silver source in a number of different fashions, such as partial metathesis of the silver source with a halogen-containing source (e.g., U.S. Pat. No. 3,457,075), coprecipitation of the silver halide and silver source material (e.g., U.S. Pat. No. 3,839,049), and any other method which intimately associates the silver halide and the silver source.

The silver source used in this area of technology is a material which contains silver ions. The earliest and still preferred source comprises silver salts of long chain carboxylic acids, usually of from 10 to 30 carbon atoms. The silver salt of behenic acid or mixtures of acids of like molecular weight have been primarily used. Salts of other organic acids or other organic materials such as silver imidazolates have been proposed, and British Pat. No. 1,110,046 discloses the use of complexes of inorganic or organic silver salts as image source materials.

The preferred binding medium for silver source comprises poly(vinyl acetal) resins, particularly poly(vinyl butyral). That class of resins is highly compatible with the silver source photothermographic emulsions and does not adversely affect the sensitometric properties of the element. Poly(vinyl acetals) are fairly soft resins and, being thermoplastic, soften more when heated. During the thermal development step, the poly(vinyl acetal) binder layer is subjected to heat and pressure which often causes the binder layer to flow. This can cause distortion or embossing of the surface characteristics of the element or even discontinuities in the imaging layer and, therefore, the image itself.

Attempts have been made to toughen or crosslink the poly(vinyl butyral) layers or provide more thermally resistant top coats. The most successfully practiced method of hardening the poly(vinyl acetal) binder layer has been the addition of crosslinking agents, and, in particular, polymethylenepolyphenylisocyanate (hereinafter PPPI). However, even though such compounds may toughen the layer and reduce its deformation under heat and pressure, they often have other adverse effects. PPPI, for example, even though it is the most common crosslinking agents for poly(vinyl butyral) layers in photothermographic emulsions causes coating problems and adversely affects a broad range of sensitometric propeties. PPPI must be added to the coating solution as late in the coating formulations process and as near to the coating step as possible. It tends to quickly crosslink the poly(vinyl acetal), change the viscosity of the solution, and clog up the coating equipment if not coated immediately. This makes both large batch operations and continuous coating operations difficult. More importantly, PPPI tends to react with functional ingredients in the emulsion and change the sensitometry of the element.

BRIEF DESCRIPTION OF THE INVENTION

The addition of boron trifluoride, boric acids, boronic acids or borates ($BO_3^-$, $BO_2^-$, $B_4O_7^{-2}$, $B_5O_8^-$) to poly(vinyl acetals) has been found to harden the resin. The use of the acids or borates in the hardening of poly(vinyl acetal) binder layers in silver source photothermographic elements reduces thermal deformation of the element during thermal development and does not significantly affect the sensitometric properties of the element.

DETAILED DESCRIPTION OF THE INVENTION

Photothermographic emulsions are usually constructed as one or two layers on a substrate. Single layer constructions must contain the silver source material, the silver halide, the developer and binder as well as optional additional materials such as toners, coating aids and other adjuvants. Two-layer constructions must contain the silver source and silver halide in one emulsion layer (usually the layer adjacent the substrate) and the other ingredients in the second layer or both layers.

The silver source material, as mentioned above, may be any material which contains a reducible source of silver ions. Silver salts of organic acids, particularly long chain (10 to 30, preferably 15 to 28 carbon atoms) fatty carboxylic acids are preferred. Complexes of organic or inorganic silver salts wherein the ligand has a gross stability constant between 4.0 and 10.0 are also desirable. The silver source material should constitute from about 20 to 70 percent by weight of the imaging layer. Preferably it is present as 30 to 55 percent by weight. The second layer in a two-layer construction would not affect the percentage of the silver source material desired in the single imaging layer.

The silver halide may be any photosensitive silver halide such as silver bromide, silver iodide, silver chloride, silver bromoiodide, silver chlorobromoiodide, silver chlorobromide, etc., and may be added to the emulsion layer in any fashion which places it in catalytic proximity to the silver source. The silver halide is generally present as 0.75 to 15 percent by weight of the imaging layer, although larger amounts up to 20 or 25 percent are useful. It is preferred to use from 1 to 10 percent by weight silver halide in the imaging layer and most preferred to use from 1.5 to 7.0 percent.

The reducing agent for silver ion may be any material, preferably organic material, which will reduce silver ion to metallic silver. Conventional photographic developers such as phenidone, hydroquinones, and catechol are useful, but hindered phenol reducing agents are preferred. The reducing agent should be present as 1 to 10 percent by weight of the imaging layer. In a two-layer construction, if the reducing agent is in the second layer, slightly higher proportions, of from about 2 to 15 percent tend to be more desirable.

Toners such as phthalazinone, phthalazine and phthalic acid are not essential to the construction, but are highly desirable. These materials may be present, for example, in amounts of from 0.2 to 5 percent by weight.

The binder for the silver source containing layer must comprise at least 25 weight percent of a poly(vinyl acetal) resin according to the practice of the present invention. Generally the binder will comprise at least 50 weight percent poly(vinyl acetal) resin, preferably at least 75 weight percent poly(vinyl acetal) and most preferably at least 90 percent or 100 weight percent poly(vinyl acetal). These percentages refer to the binder itself and is exclusive of the active ingredients therein. The binder usually comprises 20 to 75 percent by weight of the silver containing layer, and preferably about 30 to 55 weight percent of that layer. Other binder components of the layer may comprise poly(vinyl chloride), poly(styrene), poly(acrylonitrile), and copolymers such as poly(vinyl acetate/vinyl chloride). Amongst the most common poly(vinyl acetals) are poly(vinyl formal) and poly(vinyl butyral). The latter is the most preferred binder.

The borate or boric acid may be added directly into the coating composition of the silver containing layer or it may be added to the top coat adjacent the silver containing layer. In the latter case, it will migrate into the poly(vinyl acetal) layer and harden it. As little as 0.05 weight percent of the acid or borate or boron trifluoride/solids of poly(vinyl acetal) has been found to promote measurable hardening in poly(vinyl acetal) compositions. Generally a range of 0.05 to 5% by weight of the boron containing compound with respect to the poly(vinyl acetal) may be used in the poly(vinyl acetal) layer. Preferably 0.1 to 2 percent by weight is used and most preferably 0.2 to 1.5 percent by weight borate is present in the binder layer. Slightly higher amounts may be used and are preferred when the borate is added from an adjacent layer such as the top coat. The borate ion (which includes salts of a boric acid) or boric acid (including hypoboric acid, boronic acid, and other boron oxide acids) may be added in any form as long as the borate ion is available for interaction with the poly(vinyl acetal). Inorganic borate salts such as the sodium, potassium, calcium, nickel, copper, iron and ammonium and aluminum salts, organic salts such as alkyl or aryl (e.g., phenyl) boric acids, ethylboric acid, n-butyl boronic acid and phenyl boric acid, and boric acid are useful sources of the ion. Materials which generate borate ion upon the action of externally applied stimulus such as heat, light, or moisture are also useful, but not preferred. The use of light sensitive salts such as triphenylsulfonium borate, diphenyliodonium borate, aromatic diazonium borate salts could work, but the need for light stimulation could interfere with the imaging process, even if the salts were sensitized to a portion of the spectrum outside the maximum sensitivity range of the photothermographic element. Heat activation prior to light exposure might also interfere with the stability of the photothermographic emulsion and is, therefore, not preferred.

The term "a boric acid" as used in the present invention means any of the boron oxide acids such as, but not limited to, boric acid, hypoboric acid, boronic acid, meta-boric acid, perboric acid, pyroboric acid and the like. Boric acid, without the indefinite article means $B(OH)_3$. "A boric acid salt" means a salt of "a boric acid".

These latent methods of addition of the boron compounds are not necessary because of the relative stability of the coating solutions of poly(vinyl acetal) and borate ion. The addition of 0.5% by weight borate/poly(vinyl butyral) to a photothermographic silver containing coating solution did not produce any measurable sensitometry changes in the final article even after storage of the solution for 24 hours at room temperature before coating. The borate thickened the solution during that period, but did not affect the sensitometry. The change in the viscosity can be readily adjusted by increasing the solvent content of the coating solution. The addition of some other crosslinking agents such as isocyanates (e.g., PPPI) has been found to provide some additional improvement in adhesion of layers.

These and other aspects of the invention will be further described in the following non-limiting examples.

EXAMPLE 1

Three thousand grams of a dispersion containing 12.5 percent by weight silver behenate, 6.5 percent methyl isobutyl ketone, 21 percent toluene, and 60 percent methyl ethyl ketone were added to a stirred reaction vessel and maintained at 15° C. Forty-five (45) grams of polyvinyl butyral and thirty (30) grams 1-methyl-2-pyrrolidinone were added with stirring. At twenty minute intervals, the following additions were made:

(1) a mixture of 75 ml 2 M HBr and 20 ml 0.1 M HI in ethanol, (2) 330 grams polyvinyl butyral and 15 ml 0.5 M HgBr2 in ethanol, and (3) 80 mg of a cyanine spectral sensitizing dye in 16 ml of 1-methyl-2-pyrrolidinone. The mixture was digested with stirring for twenty minutes.

To a 700 gram aliquot of this master batch was added 9 grams of a hindered phenol developer (1,1-bis(2-hydroxy-3,5-dimethylphenyl)-3,5,5-trimethylhexane) and 3 grams of phthalazinone. After stirring for 20 minutes at 15° C., this was knife-coated at 100 microns wet thickness onto polyester and dried in a forced draft at 85° C. for 4 minutes. 0.5 percent by weight of boric acid, $H_3Br_3$ was included in the silver containing layer by direct addition along with the phthalazinone.

A top coat of a 5 percent solids solution of a poly(vinyl acetate)/poly(vinyl chloride) copolymer (80/20) in methyl ethyl ketone was applied to the dried first coating at 65 microns wet thickness and dried in the same manner as the first coating. An identical photothermographic article was made without the addition of the boric acid.

The two articles were identically exposed and then developed by heating on a roll drum at 110° C. for ten seconds. The surface of the roll drum had a fine mesh screen thereon to intensify pressures on the article's surface during development. The article without the boric acid showed a sharp mesh pattern on its surface after development. The pattern was so apparent that it could be manually felt and appeared to have a delustered, matte finish. The surface of the photothermographic article with the boric acid still appeared shiny, and only modest texturing could be seen on the surface.

More importantly, when the top coat was stripped from both articles and light shown through the developed articles, an intense pattern of areas allowing light to be transmitted through the article without the borate could be seen. The pattern approximately corresponded to the impressed raised areas on the impacting mesh during development. No such pattern could be visually determined on the article treated with the borate. Under microscopic examination, some displacement within the image could be detected. There was, however, no difference in sensitometry between the two articles.

EXAMPLE 2

Example 1 was repeated except that the boric acid was placed in a top coat having the composition, with the phthalazinone left out of the silver containing coating:

| | |
|---|---|
| Acetone | 71.33 g |
| Methyl Cellosolve | 17.22 |
| MeOH | 6.11 |
| Cellulose Acetate | 4.11 |
| Inert Fluorochemical Surfactant | 0.04 |
| Phthalazine | .52 |
| 4-Methylphthalic Acid | .37 |
| Tetrachlorophthalic Anhydride | .11 |
| Tetrachlorophthalic Acid | .25 |
| $H_3BO_3$ (dissolved in methyl cellosolve) | .12 |

This top coat composition was dried in the same manner as the top coat in Example 1. An identical photothermographic article without boric acid was also made. After imaging and development as shown in Example 1, observation of the articles showed parallel results with the articles of Example 1. The photothermographic element without the borate ion had visually observable surface markings and displacement of the silver-containing layer. The article with the borate ion still possessed a shiny surface with only modest indentation thereon and exhibited displacement of the silver-containing layer only under microscopic examination. Otherwise, there was no difference in sensitometry between the two samples.

EXAMPLES 3–7

Example 2 was repeated except that the boric acid was replaced with a molar equivalent amount of the following compounds:

3. Sodium borate, $NA_2B_4O_7.H_2O$
4. Ammonium pentaborate, $NH_4B_5O_8.4H_2O$
5. Phenylboric acid, $C_6H_5B(OH)_2$
6. n-Butylboronic acid, $C_4H_8B(OH)_2$
7. Boron trifluoride complex, $BF_3.2CH_3OH$ All compounds were found to harden the poly(vinyl butyral). The phenyl boric acid was found to be the least active of the group. The boron trifluoride was found to destroy the dry silver sensitivity because of some reaction with the emulsion. It is, therefore, not particularly useful in the dry silver construction without some barrier properties being developed to keep the boron trifluoride from the emulsion.

EXAMPLE 8

Example 2 was repeated except that 0.19 grams of PPPI was added along with the boric acid. The same hardness resulted, and there was slightly greater adherence of the coatings to the polyester base. Because of the small amount of PPPI, there was no adverse effect on the sensitometry of the films.

I claim:

1. An unexposed photothermographic article comprising a support, a silver containing layer comprising a binder, a silver compound having reducible silver ions, silver halide in catalytic proximity to said silver compound, and a reducing agent for silver ion, said binder comprising at least 25 percent by weight of a poly(vinyl acetal), said article being characterized by the presence of an amount of borate ion, a boric acid salt, or a boric acid, alone or in combination with an isocyanate, sufficient to harden said binder.

2. The article of claim 1 wherein said binder comprises at least 50 percent by weight of poly(vinyl acetal).

3. The article of claim 1 wherein said binder comprises at least 75 percent by weight of poly(vinyl acetal).

4. The article of claim 1 wherein said binder comprises at least 90 percent by weight of poly(vinyl acetal).

5. The article of claim 1 wherein said binder comprises 100 percent by weight of poly(vinyl acetal).

6. The article of claim 1 wherein said borate is in the form of an inorganic borate salt, an organic borate salt, or boric acid.

7. The article of claim 3 wherein said borate is selected from the group consisting of boric acid, boric acid salts, boronic acid, boronic acid salts, meta-boric acid, meta-boric acid salts, pyroboric acid, pyroboric acid salts, perboric acid, perboric acid salts, alkyl boric acids, alkyl boric acid salts, aryl boric acids and aryl boric acid salts.

8. The article of claim 4 wherein said borate is selected from the group consisting of boric acid, boric acid salts, boronic acid, boronic acid salts, meta-boric acid, meta-boric acid salts, pyroboric acid, pyroboric acid salts, perboric acid, perboric acid salts, alkyl boric acids, alkyl boric acid salts, aryl boric acids and aryl boric acid salts.

9. The article of claim 5 wherein said borate is selected from the group consisting of boric acid, boric acid salts, boronic acid, boronic acid salts, meta-boric acid, meta-boric acid salts, pyroboric acid, pyroboric acid salts, perboric acid, perboric acid salts, alkyl boric acids, alkyl boric acid salts, aryl boric acids and aryl boric acid salts.

10. The article of claim 1 wherein said poly(vinyl acetal) is selected from the group consisting of poly(vinyl formal) and poly(vinyl butyral).

11. The article of claim 3 wherein said poly(vinyl acetal) is selected from the group consisting of poly(vinyl formal) and poly(vinyl butyral).

12. The article of claim 8 wherein said poly(vinyl acetal) is selected from the group consisting of poly(vinyl formal) and poly(vinyl butyral).

13. The article of claim 9 wherein said poly(vinyl acetal) is selected from the group consisting of poly(vinyl formal) and poly(vinyl butyral).

14. The article of claim 11 wherein said poly(vinyl formal) comprises poly(vinyl butyral).

15. The article of claim 12 wherein said poly(vinyl formal) comprises poly(vinyl butyral).

16. The article of claim 13 wherein said poly(vinyl formal) comprises poly(vinyl butyral).

17. An unexposed photothermographic article comprising a support, a silver containing layer comprising a binder, a silver compound having reducible silver ions, silver halide in catalytic proximity to said silver compound, and a reducing agent for silver ion, said binder comprising at least 50 percent by weight of a poly(vinyl acetal), said article being characterized by the presence of an amount of hardening agent for said poly(vinyl acetal) sufficient to harden said binder, said hardening agent consisting essentially of borate ion, a boric acid salt, or a boric acid.

18. The article of claim 17 wherein said binder comprises 100 percent by weight of poly(vinyl acetal).

19. The article of claim 17 wherein said borate is in the form of an inorganic borate salt or an organic borate salt.

* * * * *